United States Patent [19]

Meiel et al.

[11] 3,974,548

[45] Aug. 17, 1976

[54] EASILY DISMANTLED PARTITION STRUCTURE

[75] Inventors: Samuel P. Meiel, Roxboro; Cameron W. Sherry, Dorion, both of Canada

[73] Assignee: Domtar Limited, Montreal, Canada

[22] Filed: Dec. 16, 1974

[21] Appl. No.: 526,903

[30] Foreign Application Priority Data

June 6, 1972 Canada ..... 145756

[52] U.S. Cl. ..... 24/204

[51] Int. Cl.[2] ..... A44B 17/00; A44B 11/00

[58] Field of Search ..... 24/204, 208.16 D

[56] References Cited

UNITED STATES PATENTS

| | | | |
|---|---|---|---|
| 3,138,841 | 6/1964 | Naimer | 24/204 |
| 3,255,749 | 6/1966 | Smithers | 24/204 |
| 3,274,616 | 9/1966 | Russo | 24/204 |
| 3,423,764 | 1/1969 | Cassling | 24/204 |
| 3,456,305 | 7/1969 | Voit | 24/205.16 R |
| 3,503,101 | 3/1970 | Kolozsvary | 24/204 |
| 3,583,057 | 6/1971 | Kolozsvary | 24/204 |
| 3,696,472 | 10/1972 | Perina | 24/204 |
| 3,717,908 | 2/1973 | Perina | 24/204 |
| 3,721,050 | 3/1973 | Perina | 52/475 |

*Primary Examiner*—Bernard A. Gelak
*Attorney, Agent, or Firm*—C. A. Rowley

[57] ABSTRACT

A partition structure incorporating fastener elements of the hook and loop type that permit dismantling of the partition by removing the panels in the direction substantially perpendicular to their faces. Also disclosed is a fastener strip roll to facilitate application of fasteners in the field.

6 Claims, 9 Drawing Figures

EASILY DISMANTLED PARTITION STRUCTURE

FIELD OF THE INVENTION

The present invention relates to a partitioning system, more specifically to a panel structure incorporating loop and hook elements to hold the panels to the studding, and to a method of erecting such a structure.

DESCRIPTION OF THE PRIOR ART

Various types of partitions, in particular easily dismantleable partitions for office buildings, have been proposed and many have found commercial application. Some such commercial systems currently being installed are dismountable but only with difficulty. Also many different techniques for mounting panels on studs have been proposed in the literature including the patent literature. However, none of these arrangements provide a commercially satisfactory structure wherein the panels may be peeled off in a direction substantially perpendicular to their face and removed directly from the studding. The majority of the partition arrangements proposed use batten strips to cover the joints between adjacent panels and to hide the mounting mechanisms securing the panels to the studs. Systems have been proposed wherein the batten strips are completely eliminated but such arrangements normally require either gluing the panels directly to the stud, which of course inherently makes dismantling difficult, or clipping the panel to the stud which requires complicated mechanical gadgetry.

It is the object of the present invention to provide a simple system for securing the panels to the stud which system facilitates both erection and dismantling of the partition wall.

It is quite common to secure the fastening elements to the panels in the field. This allows more leeway to determine the number of fasteners used, etc., and permits more leeway in the positioning or number of studs used. This is particularly important where panels must be cut, for example in corners and the fastening elements must be provided to cooperate with the stud at the end of the wall.

It is thus a further object of the present invention to provide a fastener strip easily connectible to the rear face of a panel.

SUMMARY OF THE INVENTION

Broadly, the present invention relates to a partition comprising studs, a plurality of discrete fastening members secured at spaced points along said studs, a panel, a plurality of mating connecting elements secured to said panel in spaced relationship for cooperating with said fastening members. One of said fastening members or said connecting elements being in the form of a plurality of loops and the other of said fastening members or said connecting elements being in the form of a plurality of hooks adapted to cooperate and lock in said loops.

The present invention also relates to a fastener strip comprising a flexible backing sheet, fastener elements secured to said backing sheet, said fastener elements being narrower than said backing sheet and being spaced a fixed distance from one edge of said sheet. Preferably the fastener strip will be supplied as a roll and the backing sheet will be of paper having a fold line spaced from said edge substantially the same distance as said fasteners.

BRIEF DESCRIPTION OF THE DRAWING

Further features, objects and advantages will be evident from the following detailed description of a preferred embodiment of the present invention taken in conjunction with the accompanying drawings in which.

DESCRIPTION OF THE PREFERRED EMBODIMENTS

Figure 1:
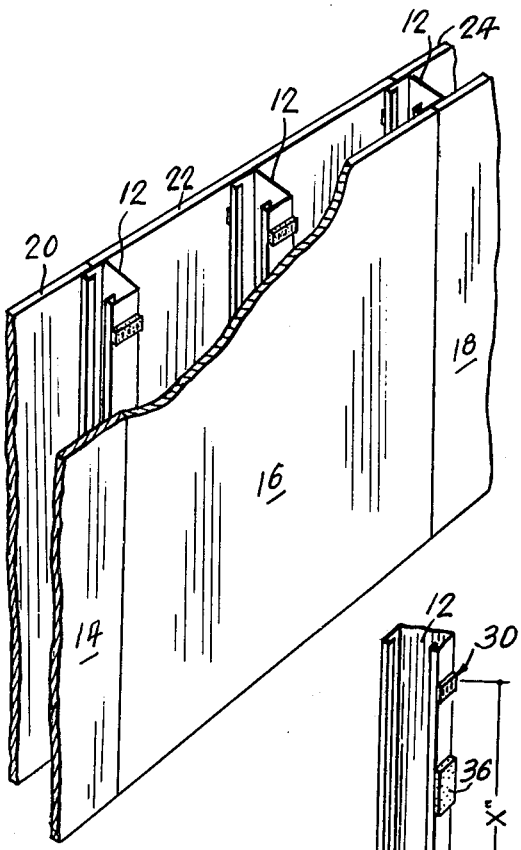
FIG. 1 is an isometric view with parts omitted showing one type of wall structure incorporating the present invention.

Generally, a wall incorporating the present invention is constructed in the conventional manner with the exception that the panels are held on the wall by a type of fastening member novel in the field of wall structures. As illustrated in FIG. 1, the wall basically comprises a plurality of substantially vertical studs 12 which in the illustrated arrangement has panels 14, 16 and 18 on one side and panels 20, 22 and 24 on the opposite side, to form two exposed wall surfaces. In the arrangement illustrated the panels are in abutting relationship and no batten strips are provided, however, if desired batten strips could be used to cover the joints or the joints could be formed in other more esthetic ways, for example, by spacing the panels slightly to provide a vertical space extending between pairs adjacent panels such as 14 and 16.

Figure 2:
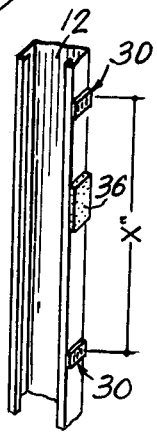
FIG. 2 is a partial isometric view illustrating a stud with mounting means connected thereto at spaced points.
Figure 3:
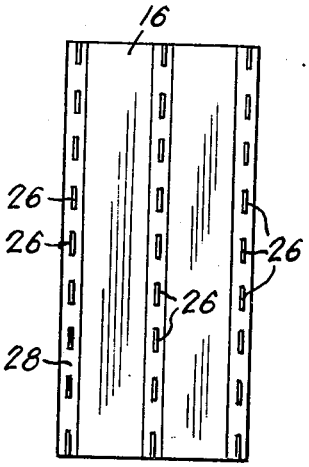
FIG. 3 is a plan view of the back of a panel to be mounted on the stud of FIG. 2.

The panels 14, 16, 18, 20, 22 and 24 are secured to the studs 12 by suitable hook and loop fastening elements such as those sold under the trade mark "VELCRO." One of the fastening elements is secured to the stud 12 while the cooperating fastening element is secured to the panel as shown in FIG. 2 and 3. These fastening elements may be secured at spaced locations to the stud as indicated at 30 and to the back of the panel as indicated at 26. The spacing between these elements 30 has been indicated as X and will generally be about 4 inches to about 3 feet preferably about 8 inches to 2 feet. Alternatively, one or both the elements 30 or 26 may extend as a continuous strip for substantially the length of the overlap between the stud and panel. In any event care must be taken to ensure that the proper amount of cooperating Velcro strips are used so that the panel is supported, yet may be dismantled without undue difficulty.

The fastening elements 26 may be secured to the panel, say panel 16 as illustrated in FIG. 3 by adhesive, however, special care must be taken when gypsum board panels are used. When gypsum panels are to be mounted, strips such as strips of kraft paper as indicated at 28 extending vertically on the panel 16 are secured thereto by a suitable adhesive. The fastening means 26 are secured to the kraft paper 28 and a satisfactory bond is obtained between the elements 26 and the panel. It has been found that the paper strip 28 should extend substantially the full height of the panel and should be at least approximately 4 inches wide. Wider strips obviously could be used but this would be simply adding extra material.

Figure 4:
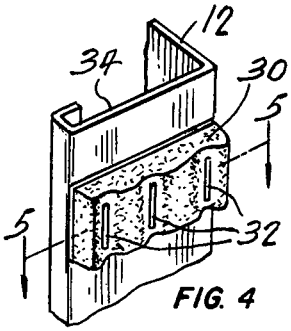
FIG. 4 is a partial but enlarged isometric view of the stud of FIG. 2 illustrating the preferred method of securing the fastening members to the stud.
Figure 6:
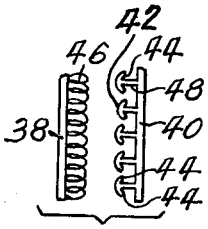
FIG. 6 is a side elevation of the looped member and preferred hook member for fastening the panels on the studs.
Figure 5:
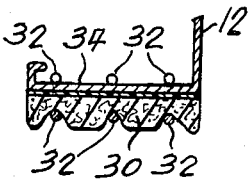
FIG. 5 is a view along the line 5—5 of FIG. 4.

Difficulty may be encountered in securing the fastening elements 30 of FIG. 2 to the studs 12 when steel studs are used, as adhesive will not properly bond these materials unless relatively expensive adhesives are used or specific steps are taken to clean the stud before application. It has been found, however, that by stapling the fastening elements 30 directly to the stud by means of suitable staples 32 as shown in FIGS. 4 and 5 adequate bonding of the fastening elements 30 can be obtained. In the illustrated arrangement 3 staples, one at each opposite end of the element and the third in the centre of the element are used, however two staples, one at each end may also be used depending on the weight of the panel to be supported.

It is important that the panel be mounted on the stud in a manner to permit little if any relative movement between the panel and stud when the panel is in position. All Velcro fasteners are not sufficiently rigid to stop this relative movement and thus are not commercially satisfactory for mounting panels as they permit the panels to shift too easily thus requiring means be provided to prevent this shifting.

Resilient means may be interposed between the stud and the panel in the area between the cooperating connecting elements to bias the panel away from the stud and thus apply tension on the hook and loop members to thereby limit the amount of relative shifting that can occur. One such system is to provide resilient members or pads 36 secured to the stud 12 and bearing against the inside of the panel 16 (see FIG. 2). Preferably, these members 36 are not connected to the panel 16. The pads 36 preferably are a foam material having resilience to the direction perpendicular to its face, i.e. perpendicular to the flange 34 but having only very limited movement in a direction parallel to the flange 34.

In the preferred embodiment a conventional loop member 38 of the Velcro type is made of, for example, nylon and cooperates with a T-shaped hook member of formed plastic material as indicated at 40. It will be noted that the T-shaped hooks 42 are relatively rigid and are each undercut on opposite sides as indicated at 44 to lock with the loops 46 of the loop member 38. The height of the stem 48 of the T-members 42 should be short and the loop length 46 should be short so that the panel 16 and stud 12 are close together. The shorter stems and loops can be made, the less opportunity for relative movement. It has been found that when using such an arrangement, resilient pads such as those illustrated at 36 may be omitted.

One suitable system incorporating Velcro loop 2000, stapled to the studs 12 at 12-inch spacings and cooperating with Velcro MVA-5 ½-inch wide hook strips either continuous or discontinuous (6 inches long at 12 inch spacing is very satisfactory) has been built and found to be quite satisfactory even without resilient pads 36.

The fastener strip may be secured to the back of the panel in a variety of different ways. It is contemplated that the backing strip and fasteners may be pre-applied at the factory or alternatively may be applied in the field. The fasteners and backing strip may be applied as a unit or the paper strip may be first applied followed by the fastener strip being applied to the paper in situ. In the latter case, paper itself may be applied by the factory and the fastener strips applied to the paper in the field. Preferably the fastener strip will be supplied separately and will include both the fastener and the backing sheets in roll form for application in the field.

Figure 7:
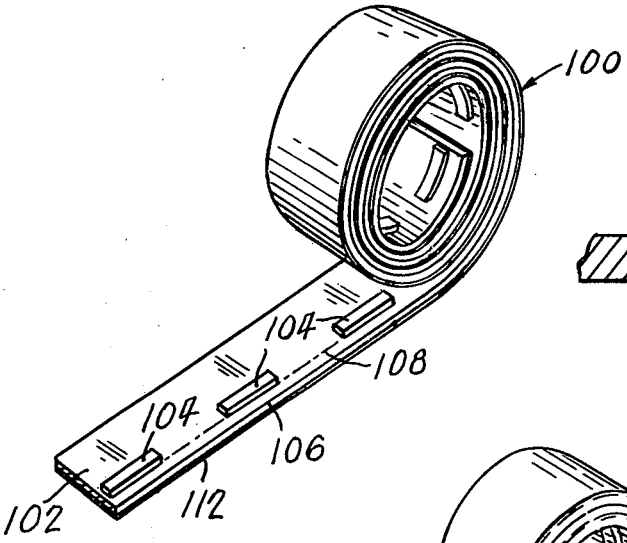
FIG. 7 is an isometric view of a fastener strip roll for application to the panels.
Figure 8:
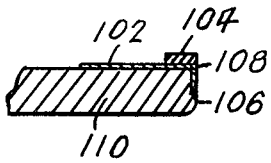
FIG. 8 is a partial sectional view through an edge of a panel having the fastener strip of FIG. 7 secured thereto.

The fastener strip roll 100 shown in FIG. 7 comprises a backing tape or sheet 102 having a plurality of spaced fastener elements 104 secured thereto at a fixed distance from one edge 106 of the sheet 102. The elements 104 thus are accurately positioned relative to this edge to facilitate positioning of the strips 104 and makes peeling of the sheet 102 from the panel more difficult since the stress is applied to the sheet 102 by the strip 104 away from the edge of the sheet 102. Preferably a fold line 108 is provided in the sheet 102 at the side edge of the fastener elements 104 adjacent the edge 106. This fold line 108 facilitates folding the sheet 102 about a corner of a panel as shown in FIG. 8 to improve the strength of the connection between the panel and sheet 102. A sheet 102 may be secured to the back of the panel such as panel 110 indicated in FIG. 8 by any suitable adhesive. The adhesive may be preapplied to the sheet 102 and be protected by a strippable tape 112 (FIG. 7). Preferably a pressure sensitive adhesive is preapplied so it is merely necessary to separate the tape 112 and press the sheet 102 against the back surface of the board 110 to fix the sheet in position. The sheet 102 preferably is relatively inexpensive material for example a suitable paper sheet.

Figure 9:
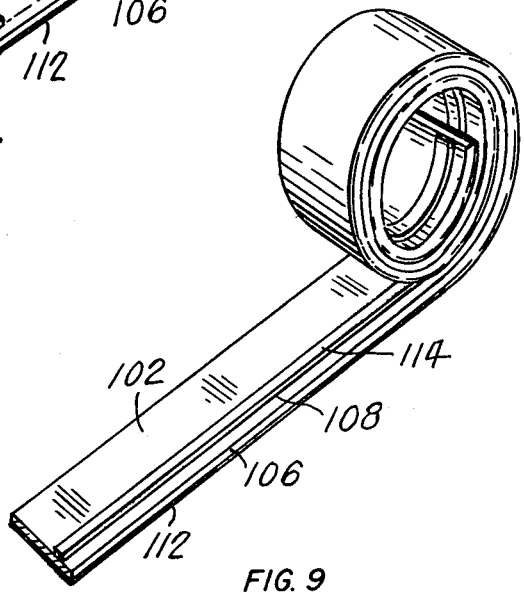
FIG. 9 is a view of a roll similar to FIG. 7 but illustrating a continuous fastener strip applied to the backing sheet.

A plurality of discrete elements 104 have been illustrated, however, a continuous strip 114 of fastener elements may be used if desired as shown in FIG. 9. When a continuous strip is used, however, it will be necessary to use the relatively rigid hook members described hereinabove or special accommodations will have to be made to provide the resilient means tensioning the loop and hook members to limit relative sliding movement. The use of a continuous strip reduces any alignment problems between the fastener on the stud and on the panel to a minimum.

The sheets 102 which are equivalent to the kraft paper strips 28 need not extend the full length of the panel as illustrated, for example, relatively short lengths could be cut and applied to the back of the panel if the spacing of the loop members on the stud is not equivalent to the spacing between the fastening elements 104 on the sheet 102 (the fastening element 104 are equivalent to the fastening element 26).

While the disclosure has illustrated mounting of 48 inch wide panels which requires the centre row of fastener elements 26 as shown in FIG. 3, it will be apparent that with narrower panels the centre row may be omitted. Similarly spaced or discrete fastening elements 26 and 30 have been provided on the panel 16 and stud 12. These elements 26 and 30 may be replaced by a continuous strip running the height of the panel or stud (as illustrated in FIG. 9 for example) but, of course, this would increase the cost and could result in too strong a connection with the result that dismantling becomes difficult. Preferably if a continuous strip is used it will be used for either the fastener element 26 or 30 but not both.

The operation of the instant invention will be apparent from the above description. The panels such as 14, 16, 18, 20, 22 or 24 are simply moved into position against the studs 12 and the fastening elements 26 and 30 cooperate to secure the panels in position. The panels are moved in a direction substantially perpendicular to their face both to apply them and to remove them when erecting or dismantling the partition to facilitate both erection and dismantling of the partition.

The description has dealt entirely with partitions incorporating studs or the like. However, the system may be used to mount decorative panels at any suitable location, for example, the studs may be replaced by filling strips on solid concrete walls or by simply Velcro strips applied to any supporting structure on which the panels are to be mounted. Similarly the strips have been illustrated as running longitudinally of the panels (vertically). They may also extend transversely of the panels.

Modifications may be made without departing from the spirit of the invention as defined in the appended claims.

We claim:

1. A fastener strip for securing panels to studs which have been provided with fastener elements, said fastener strip comprising a backing strip, cooperating fastener element means secured to one face of said backing strip, said cooperating fastener element means being spaced from the side edges of said backing strip and having one edge thereof substantially parallel to the longitudinal axis of said backing strip and located more closely adjacent to one side edge of said backing strip, a fold line extending substantially parallel to the longitudinal axis of said backing strip and along said one side edge of said cooperating fastener element means, said fold line facilitating folding said strip over an edge of a panel, a layer of adhesive positioned substantially over the entire surface of the opposite face of said strip for securing said strip to said panel one of said fastener elements and said cooperating fastener element being in the form of a plurality of loops and the other of said fastening elements and said cooperating fastening element means being a plurality of hooks to cooperate with such loops.

2. A fastener strip as defined in claim 1 wherein said fastener means comprises a strip of fastener elements extending the length of said backing strip.

3. A fastener strip as defined in claim 1 wherein said fastener element means comprise a plurality of discrete fastener elements secured to said strip in spaced relationship.

4. A fastener strip as defined in claim 1 wherein said backing strip with said fastening element means secured thereto is wound to form a roll.

5. A fastener strip as defined in claim 1 wherein said backing strip is at least 4 inches wide.

6. A fastener strip as defined in claim 1 wherein adhesive being a pressure sensitive adhesive and a strippable protective strip overlying said pressure sensitive adhesive.

* * * * *